US010439346B2

(12) United States Patent
He

(10) Patent No.: US 10,439,346 B2
(45) Date of Patent: Oct. 8, 2019

(54) ELASTIC PIECE STRUCTURE AND ADAPTER

(71) Applicant: HYC Co., Ltd., Qingyuan (CN)

(72) Inventor: Yong He, Qingyuan (CN)

(73) Assignee: HYC Co., Ltd., Qingyuan, Guangdong (CN)

( * ) Notice: Subject to any disclaimer, the term of this patent is extended or adjusted under 35 U.S.C. 154(b) by 8 days.

(21) Appl. No.: 15/855,667

(22) Filed: Dec. 27, 2017

(65) Prior Publication Data

US 2019/0052038 A1 Feb. 14, 2019

(30) Foreign Application Priority Data

Aug. 10, 2017 (CN) ..... 2017 2 0996509 U

(51) Int. Cl.

| | |
|---|---|
| ***H01R 13/73*** | (2006.01) |
| ***H01R 33/97*** | (2006.01) |
| ***H01R 33/94*** | (2006.01) |
| ***H01R 31/06*** | (2006.01) |
| ***H01R 13/74*** | (2006.01) |

(52) U.S. Cl.

CPC ..... *H01R 33/97* (2013.01); *H01R 13/743* (2013.01); *H01R 13/745* (2013.01); *H01R 31/06* (2013.01); *H01R 33/94* (2013.01)

(58) Field of Classification Search

CPC ..... H01R 33/97; H01R 13/74; H01R 13/741; H01R 13/745; H01R 31/06; H01R 33/94

USPC ..... 439/553, 557, 571, 572

See application file for complete search history.

(56) References Cited

U.S. PATENT DOCUMENTS

| | | | | |
|---|---|---|---|---|
| 4,738,626 | A * | 4/1988 | Reichle | H02G 3/083 439/553 |
| 6,238,243 | B1 * | 5/2001 | Lorenz | H05K 7/1452 439/551 |
| 6,575,794 | B1 * | 6/2003 | Nakamura | H01R 13/506 439/352 |
| 7,077,696 | B2 * | 7/2006 | Haga | H01R 13/745 439/553 |
| 8,323,050 | B2 * | 12/2012 | Stantchev | H01R 13/6395 439/34 |

* cited by examiner

*Primary Examiner* — Khiem M Nguyen

(74) *Attorney, Agent, or Firm* — Gregory L. Porter; Hunton Andrews Kurth LLP

(57) ABSTRACT

An elastic piece structure and an adapter are disclosed. The elastic piece structure includes a mounting portion, a T-shaped curved elastic piece and an anti-falling structure. The T-shaped curved elastic piece includes a first elastic portion bending outward and a first abutting portion abutting against a panel. One end of the first elastic portion is connected to the mounting portion and the other end of the first elastic portion is connected to a middle part of the first abutting portion. The anti-falling structure is disposed on a side of the mounting portion. The elastic piece structure uses the T-shaped curved elastic piece and the anti-falling structure and is fixed without screws, alleviating shaking between a product and the panel and ensuring a firm attachment between the product and the panel.

15 Claims, 5 Drawing Sheets

--Prior Art--

--Prior Art--

ELASTIC PIECE STRUCTURE AND ADAPTER

CROSS-REFERENCES TO RELATED APPLICATIONS

This application claims priority to Chinese patent application No. CN201720996509.5, filed on Aug. 10, 2017, the disclosure of which is incorporated herein by reference in its entirety.

TECHNICAL FIELD

The present disclosure relates to the field of elastic pieces and, in particular, to an elastic piece structure and an adapter.

BACKGROUND

At present, an adapter is inserted into a chassis or a panel of some machine (such as a host). To prevent the adapter from falling off, the adapter is usually provided with a reverse plastic buckle, as illustrated in FIG. 1. However, when a large gap exists between the adapter and the chassis or the panel, the adapter is easy to shake. Thus, the adapter and the chassis or the panel need to be secured by screws, consuming time, manpower and material resources. The same problem persists when reverse metal buckles are disposed on two sides of the adapter as illustrated in FIG. 2.

SUMMARY

The present disclosure provides an elastic piece structure. The elastic piece structure adopts a T-shaped curved elastic piece that has good resilience and contacts a panel in a larger area. The T-shaped curved elastic piece is brought into close contact with the panel at a wall of a mounting hole and an anti-falling structure abuts against the panel from above, thereby alleviating shaking between an adapter and the panel.

The present disclosure further provides an adapter. The adapter is provided with an elastic piece structure having a T-shaped curved elastic piece. The T-shaped curved elastic piece is brought into close contact with the panel from a mounting hole wall and an anti-falling structure abuts against the panel from above, with no screw used, anti-falling thereby alleviating shaking between the adapter and the panel and ensuring a firm attachment between the adapter and the panel.

The following lists the reference numbers:

1—elastic piece structure, 11—mounting portion, 21—T-shaped curved elastic piece, 211—first elastic portion, 212—first abutting portion, 31—anti-falling structure, 311—second elastic portion, 312—second abutting portion, 313—third elastic portion, 314—third abutting portion, 315—abutting block, 316—reverse buckle, 2—panel, 3—adapter body

DETAILED DESCRIPTION

The present disclosure will be further described below with reference to FIGS. 3 to 6 and through embodiments.

An elastic piece structure 1 of the present embodiment is disposed outside a product. The product may be an adapter or the like. The adapter is inserted into a mounting hole of a panel. A bottom of the panel 2 abuts against a limiting structure of the adapter. The adapter is fixed to the panel 2 by the elastic piece structure 1. The panel 2 may be a chassis faceplate, a case faceplate, etc.

Figure 1:
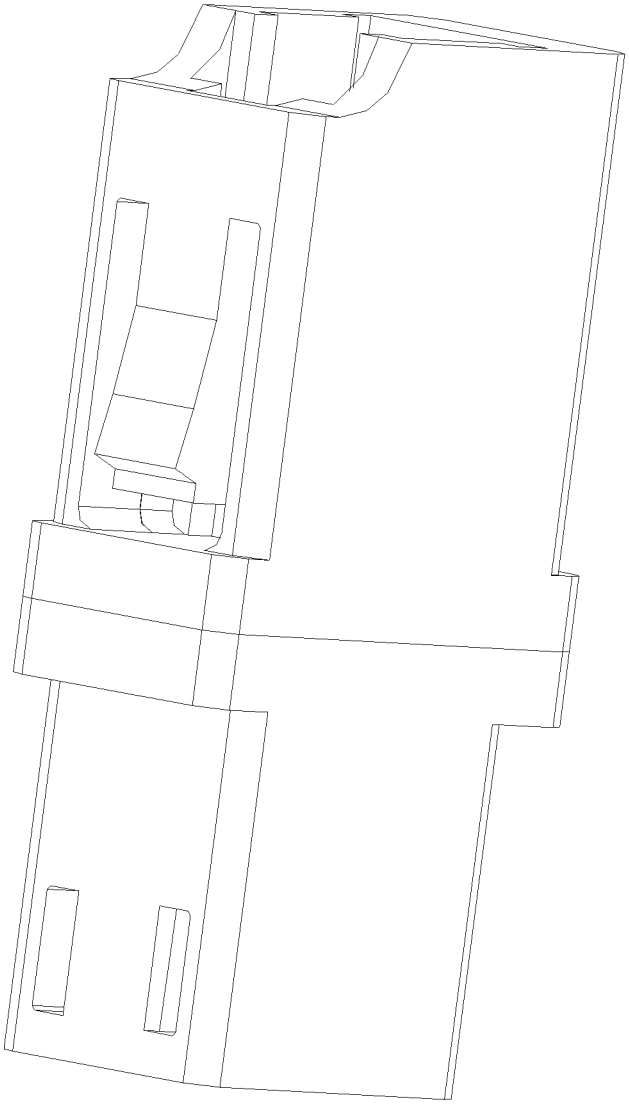
FIG. 1 is an exploded view of an adapter in the related art.
Figure 2:
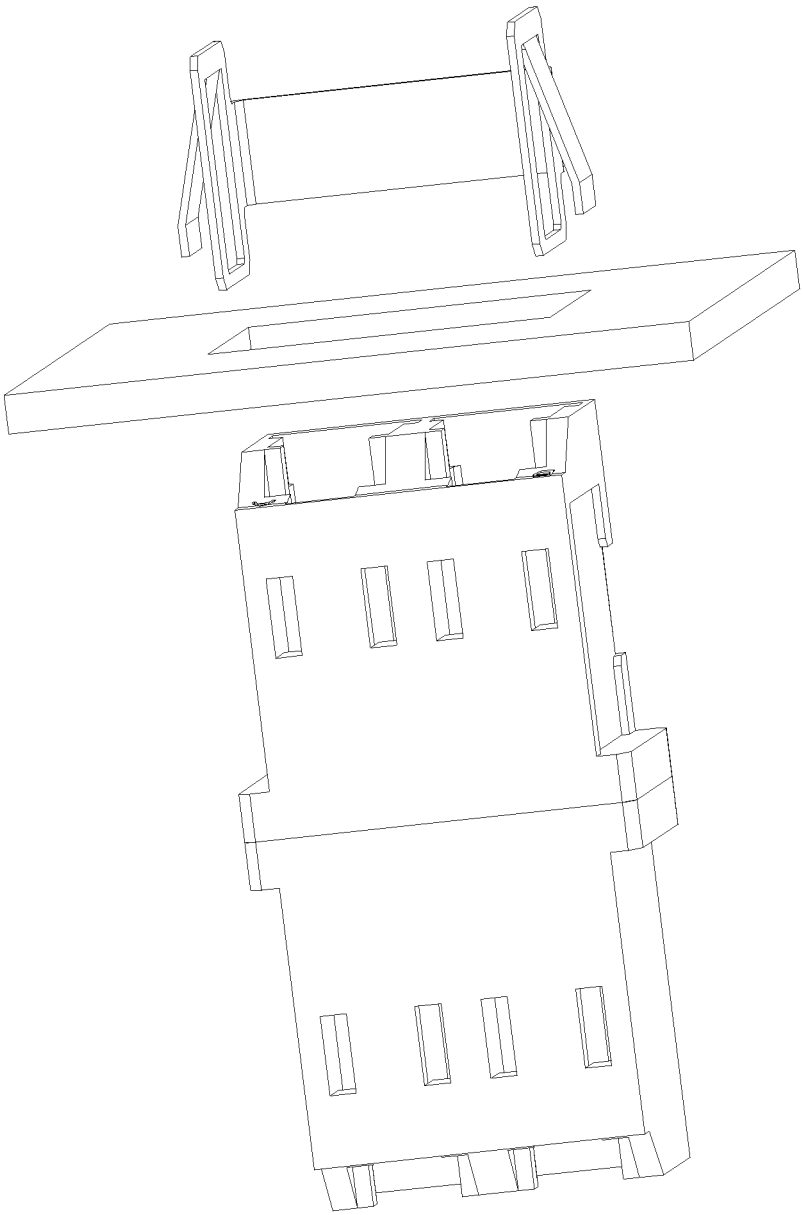
FIG. 2 is a structural diagram of another adapter in the related art.
Figure 3:
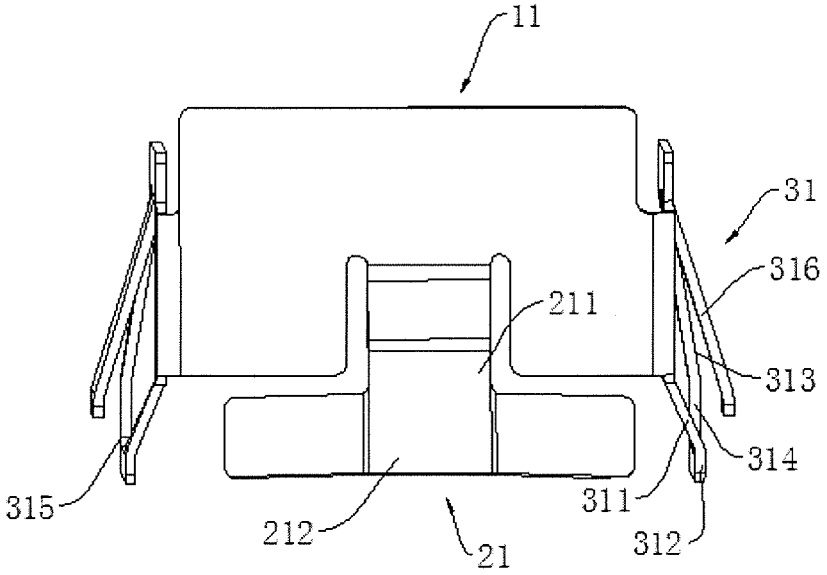
FIG. 3 is a structural diagram of an elastic piece structure according to the present disclosure.

Referring to FIG. 3, the elastic piece structure of the present embodiment includes a curved mounting portion 11 outside the adapter, a T-shaped curved elastic piece 21 and an anti-falling structure 31. The T-shaped curved elastic piece includes a first elastic portion 211 bending outward and a first abutting portion 212 abutting against the panel 2. One end of the first elastic portion 211 is connected to the mounting portion 11 and the other end of the first elastic portion 211 is connected to a middle part of the first abutting portion 212. The anti-falling structure 31 is disposed on a side of the mounting portion 11.

The elastic piece structure 1 of the present embodiment uses the T-shaped curved elastic piece 21. The outward-bent first elastic portion 211 of the T-shaped curved elastic piece 21 has good resilience. The first abutting portion 212 of the T-shaped curved elastic piece 21 contacts the panel 2 in a larger area, so that the T-shaped curved elastic piece 21 is inserted into the mounting hole and is in tight contact with the panel 2 at a side wall. The anti-falling structure 31 abuts against the panel 2 from above, thereby alleviating shaking of the adapter and ensuring a firm engagement between the adapter and the panel 2. The elastic piece structure 1 of the present disclosure uses the T-shaped curved elastic piece 21 and the anti-falling structure 31 and needs no screw for fixing, alleviating shaking between the adapter and the panel 2 and ensuring a firm attachment between the adapter and the panel 2.

Figure 4:
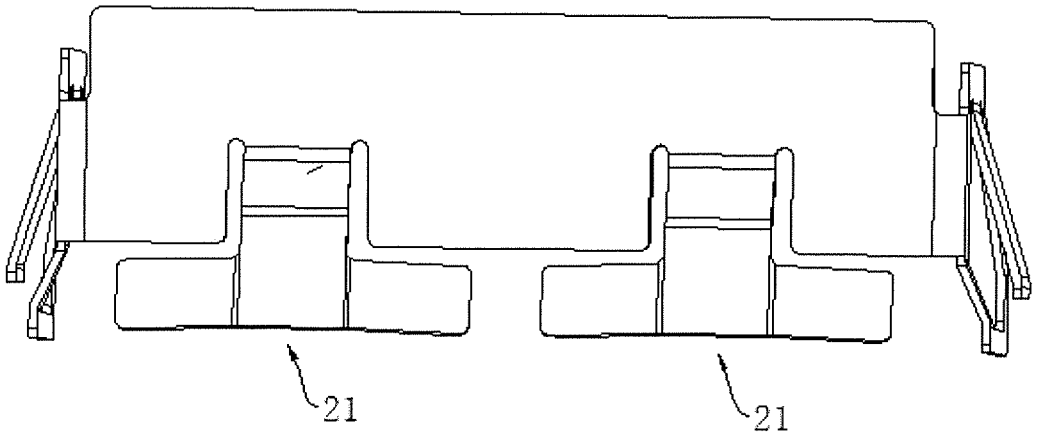
FIG. 4 is a structural diagram of an elastic piece structure according to the present disclosure.

Furthermore, referring to FIGS. 3 and 4, the mounting portion 11 is C-shaped or U-shaped and the number of the T-shaped curved elastic pieces 21 is 1 or at least 2. The mounting portion 11 is C-shaped, i.e., arc-shaped, including being half-round. The C-shaped or U-shaped mounting portion 11 can be securely fixed to the outside of the adapter and be stably connected to the adapter. The number of the T-shaped curved elastic pieces 21 may be configured according to a length of the mounting portion 11. When the mounting portion 11 is fairly long, the number of the T-shaped curved elastic pieces 21 may be increased appropriately.

Optionally, both a left side and a right side of the first abutting portion 212 are bent inward to form bent portions or the first abutting portion 212 is arc-shaped. When both the left side and the right side of the first abutting portion 212 are bent inward to form bent portions or the first abutting portion 212 is arc-shaped, the first abutting portion 212 has a certain elasticity and applies two-dimensional pressure to the panel 2 with a better stability.

One side of the anti-falling structure 31 is provided with a second elastic piece including an upward-bent second elastic portion 311 and a second abutting portion 312 connected to the second elastic portion 311. Another side of the anti-falling structure 31 is provided with a third elastic piece including an upward-bent third elastic portion 313 and a third abutting portion 314 connected to the third elastic portion 313. An abutting block 315 is disposed between the second abutting portion 312 and the third abutting portion 314.

The outward-bent second elastic portion 311 and the third elastic portion 313 have good resilience and thus can be easily inserted into the panel 2. The second abutting portion 312 and the third abutting portion 314 are in tight contact with the wall of the mounting hole of the panel 2, thereby preventing laterally shaking. The adapter and the panel 2 are fixed without screws, thereby alleviating laterally shaking between the adapter and the panel 2 and ensuring a stable attachment between the adapter and the panel 2. The second abutting portion 312, the third abutting portion 314 and the abutting block 315 together enable a larger contact area on the wall of the mounting hole of the panel 2 and enable the mounting hole of the panel 2 to undergo forces evenly to better alleviate leftward or rightward shaking of the adapter. The reverse buckle 316 prevents the adapter from slipping off from the panel 2.

Figure 5:
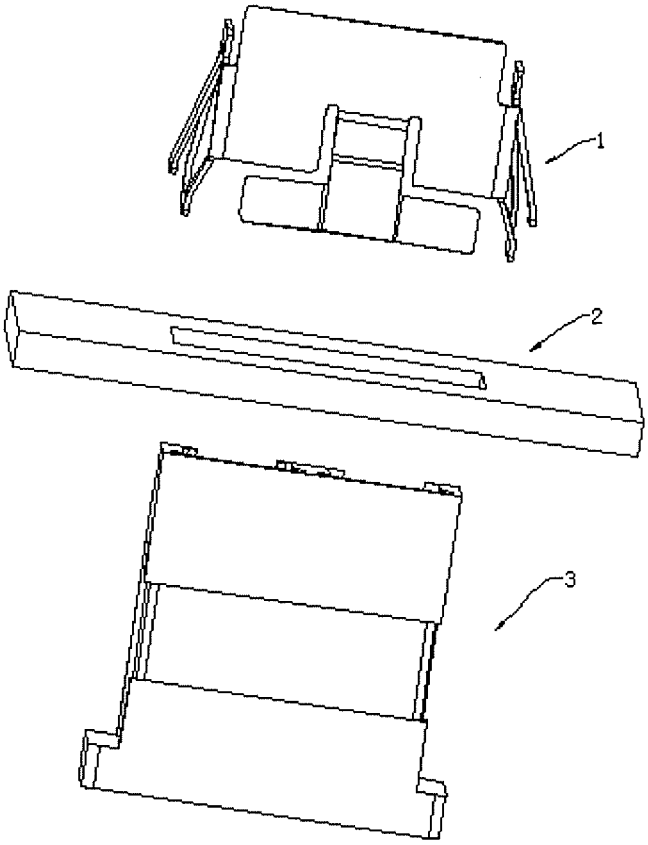
FIG. 5 is an exploded view of an adapter according to the present disclosure.
Figure 6:
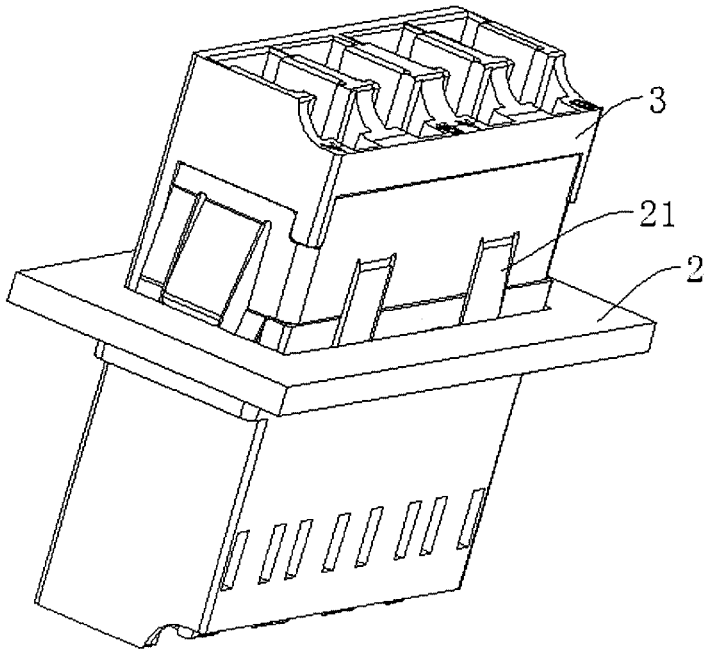
FIG. 6 is a structural diagram of the adapter after assembled according to the present disclosure.

Referring to FIGS. 5 and 6, an adapter includes an adapter body 3 and the above elastic piece structure 1. A recess matching the elastic piece structure 1 is disposed outside the adapter body 3 and the elastic piece structure 1 is disposed in the recess. The adapter is provided with a limiting structure abutting against the panel 2.

The T-shaped curved elastic piece has good resilience and contacts the panel in a larger area. The T-shaped curved elastic piece extends into an mounting hole and is brought into close contact with the panel at a wall of the mounting hole, thereby alleviating shaking. The anti-falling structure abuts against the panel from above to prevent the product from falling off, and no screw is required to fix the product and the panel, thereby alleviating shaking between the product and the panel and ensuring a firm attachment between the product and the panel. The elastic piece structure uses the T-shaped curved elastic piece and the anti-falling structure and is not secured by screws, alleviating shaking between the product and the panel and ensuring a firm attachment between the product and the panel.

The above are merely embodiments of the present disclosure. It will be apparent to those skilled in the art that modifications may be made in embodiments and application scope based on the concept of the present disclosure. The content of this specification is not to be construed as limiting the present disclosure.

What is claimed is:

1. A elastic piece structure, comprising:

a mounting portion;

a T-shaped curved elastic piece, wherein the T-shaped curved elastic piece comprises a first elastic portion bending outward and a first abutting portion abutting against a panel, a first end of the first elastic portion is connected to the mounting portion and a second end of the first elastic portion is connected to a middle part of the first abutting portion; and an anti-falling structure, disposed on a side of the mounting portion, wherein a first side of the anti-falling structure is provided with a second elastic piece comprising a second elastic portion bending upward and a second abutting portion connected to the second elastic portion.

2. The elastic piece structure of claim 1, wherein the mounting portion is C-shaped or U-shaped.

3. The elastic piece structure of claim 1, wherein a number of the T-shaped curved elastic pieces is greater than or equal to 1.

4. The elastic piece structure of claim 1, wherein both a left side and a right side of the first abutting portion are bent inward to form a bent portion.

5. The elastic piece structure of claim 1, wherein the first abutting portion is arc-shaped.

6. The elastic piece structure of claim 1, wherein a second side of the anti-falling structure is provided with a third elastic piece comprising an third elastic portion bending upward and a third abutting portion connected to the third elastic portion, and wherein an abutting block is disposed between the second abutting portion and the third abutting portion.

7. The elastic piece structure of claim 1, wherein the anti-falling structure is a reverse buckle.

8. An adapter, comprising: an adapter body and an elastic piece structure, wherein a recess matching the elastic piece structure is disposed outside the adapter body and the elastic piece structure is disposed in the recess, wherein the elastic piece structure comprises:

a mounting portion;

a T-shaped curved elastic piece, wherein the T-shaped curved elastic piece comprises a first elastic portion bending outward and a first abutting portion abutting against a panel, a first end of the first elastic portion is connected to the mounting portion and a second end of the first elastic portion is connected to a middle part of the first abutting portion; and an anti-falling structure, disposed on a side of the mounting portion, wherein a first side of the anti-falling structure is provided with a second elastic piece comprising a second elastic portion bending upward and a second abutting portion connected to the second elastic portion.

9. The adapter of claim 8, wherein the adapter is provided with a limiting structure abutting against the panel.

10. The adapter of claim 8, wherein the mounting portion is C-shaped or U-shaped.

11. The adapter of claim 8, wherein a number of the T-shaped curved elastic pieces is greater than or equal to 1.

12. The adapter of claim 8, wherein both a left side and a right side of the first abutting portion are bent inward to form a bent portion.

13. The adapter of claim 8, wherein the first abutting portion is arc-shaped.

14. The adapter of claim 8, wherein a second side of the anti-falling structure is provided with a third elastic piece comprising an third elastic portion bending upward and a third abutting portion connected to the third elastic portion, and wherein an abutting block is disposed between the second abutting portion and the third abutting portion.

15. The adapter of claim 8, wherein the anti-falling structure is a reverse buckle.

* * * * *